US006851214B2

(12) United States Patent
Oz

(10) Patent No.: US 6,851,214 B2
(45) Date of Patent: Feb. 8, 2005

(54) FLASHLIGHT MOUNT FOR A FIREARM

(75) Inventor: David Oz, London (GB)

(73) Assignee: T. D. I. Arms Systems Ltd, Tel Aviv (IL)

( * ) Notice: Subject to any disclaimer, the term of this patent is extended or adjusted under 35 U.S.C. 154(b) by 117 days.

(21) Appl. No.: 10/669,190

(22) Filed: Sep. 24, 2003

(65) Prior Publication Data

US 2004/0055202 A1 Mar. 25, 2004

(30) Foreign Application Priority Data

Sep. 25, 2002 (IL) ..... 151933

(51) Int. Cl.[7] ..... F41C 3/14
(52) U.S. Cl. ..... 42/146; 42/111; 42/148
(58) Field of Search ..... 42/146, 111, 114

(56) References Cited

U.S. PATENT DOCUMENTS 3,512,290 A * 5/1970 La Violette, Jr. et al. .. 42/75.01
4,533,980 A * 8/1985 Hayes ..... 362/110
4,542,447 A * 9/1985 Quakenbush ..... 362/183
4,571,870 A * 2/1986 Heideman et al. ..... 42/1.01
5,027,542 A * 7/1991 Simonetti ..... 42/72
5,107,612 A * 4/1992 Bechtel ..... 42/115
5,590,484 A 1/1997 Mooney et al.
5,685,105 A 11/1997 Teetzel
5,727,346 A * 3/1998 Lazzarini et al. ..... 42/146
5,852,892 A 12/1998 Bilgeri et al.
5,881,486 A 3/1999 Bilgeri et al.
5,913,669 A * 6/1999 Hansen et al. ..... 42/146
6,115,952 A * 9/2000 Rigler ..... 42/146
6,318,015 B1 11/2001 Baumann et al.
6,378,237 B1 4/2002 Matthews et al.
6,622,416 B2 * 9/2003 Kim ..... 42/146
6,655,069 B2 * 12/2003 Kim ..... 42/114

OTHER PUBLICATIONS

KAC RIS and RAS at www.quarterbore.com/kac/kac-risras.html (3 pages) Jun. 16, 2003.
KAC Free Float RAS at www.quarterbore.com/kac/kacf-fras.html (5 pages) Jun. 16, 2003.
SOPMOD M4 Carbine at www.quarterbore.com/kac/sop-mod.html (3 pages) Jun. 15, 2003.

* cited by examiner

*Primary Examiner*—Michael J. Carone
*Assistant Examiner*—M. Thomson
(74) *Attorney, Agent, or Firm*—Robert L. Stone

(57) ABSTRACT

A flashlight mount, and a method for mounting a flashlight, for a rifle having a barrel and a mounting rail coupled to the barrel, the flashlight mount including a frame having a bore for receiving a flashlight, the frame defining a substantially flattened bottom surface, and a base for mounting along the mounting rail, the base being distanced from the frame, thereby creating a finger-receiving aperture therebetween.

14 Claims, 2 Drawing Sheets

FLASHLIGHT MOUNT FOR A FIREARM

FIELD OF THE INVENTION

The present invention relates to a light holder for mounting on a rifle, in general, and, in particular, to a flashlight mount for mounting on an existing rail structure on the weapon.

BACKGROUND OF THE INVENTION

In recent years, the increasing complexity of combat has generated a need for weapons with increased accuracy and which are capable of supporting various accessories, such as flashlights, infrared and night vision scopes, laser spotters, and so forth. Consequently, a wide variety of mounts for rifles and other hand weapons have been developed which permit the mounting of lights scopes and the like on the weapon, often along the barrel.

A few examples are as follows. There is known from U.S. Pat. No. 5,590,484, to Mooney et al., a universal mount for a rifle which is formed to support a series of accessory devices simultaneously. The mount comprises an upper rail, a lower rail, a heat shield, and a retaining clip. When in place, this mount enables the rifle to be used as a weapons' platform, simultaneously supporting a plurality of accessory devices that enhance the operational capabilities of the weapon. A major feature of this invention is that the mount is secured to the barrel so that it "follows" the direction of the barrel when the latter undergoes thermal deformation as a result of firing successive rounds of ammunition, which enables the weapon to remain accurate despite the number of rounds fired or the temperature of the barrel.

A collimator holding device for a weapon barrel is described in U.S. Pat. No. 6,318,015 to Baumann, et al., which includes a casing extension on the casing of the weapon, and a longitudinal rail integrally formed on the top of the casing and on the casing extension as a mounting for the telescopic sight.

Another hand-held firearm with a light casing is described in U.S. Pat. No. 5,881,486 to Bilgeri et al. This firearm also includes a casing extension having a mounting for a telescopic sight.

There is shown in U.S. Pat. No. 6,378,237 to Matthews et al. a firearm with target illuminators including a track and slide combination including a slide on the target illuminator and a track structure clamped to the trigger guard on the weapon for that slide, and a releasable slide-in-track stop in the track and slide combination.

Another apparatus for attaching a flashlight to a firearm is illustrated in U.S. Pat. No. 5,685,105 to Teetzel. This apparatus includes a chassis containing a flashlight that can be mounted in various positions, depending on the weapon selected. The weapons factory installed hand grips are replaced by modified hand grips that contain the flashlight electronic controls, water proof activation switches, and power source.

These prior art devices suffer from a number of disadvantages. First, conventional flashlight mounts are substantially cylindrical in cross-section, such that their bottom surface is curved, so they provide no stability if the weapon is leaned upon a wall, for example. Second, often the mounts are relatively small, so as to permit mounting of several different accessories and reduce weight. However, this structure makes it difficult to comfortably grip the weapon while holding the light mount, and often places the user's hand in close proximity to the hot barrel during firing. Third, conventional mounts generally have a selected location along the barrel at which they are affixed. Thus, this location is often not optimal for users of different heights and different arm lengths.

Accordingly, there is a long felt need for a flashlight mount for a rifle or other hand-held firearm which is provides a strong grip, and stability for the weapon, and it would be desirable to have such a mount whose mounting location along the barrel is adjustable according to the length of the arm of the user.

SUMMARY OF THE INVENTION

The present invention provides a flashlight mount for a rifle or carbine, such as a M-16, or other hand held firearm having an elongate barrel and a mounting rail coupled to the barrel, the flashlight mount including a frame having a throughgoing bore for receiving a flashlight, the frame defining a substantially flattened bottom surface, and a base for mounting along the mounting rail, the base being distanced from the frame creating a finger-receiving aperture therebetween.

According to a preferred embodiment of the invention, the location of the frame is adjustable along the rail.

According to another embodiment, the frame includes a plurality of flattened rings around the bore, arranged for easy and secure gripping by fingers of a user.

Further according to a preferred embodiment, the frame includes an outwardly extending flange at each end, providing stops for a hand of a user.

BRIEF DESCRIPTION OF THE DRAWINGS

The present invention will be further understood and appreciated from the following detailed description taken in conjunction with the drawings in which.

DETAILED DESCRIPTION OF THE INVENTION

The present invention relates to a flashlight holder or mount for a rifle or carbine, which provides a comfortable and secure grip under the barrel, and whose location along the barrel is adjustable, relative to the stock.

Figure 1:
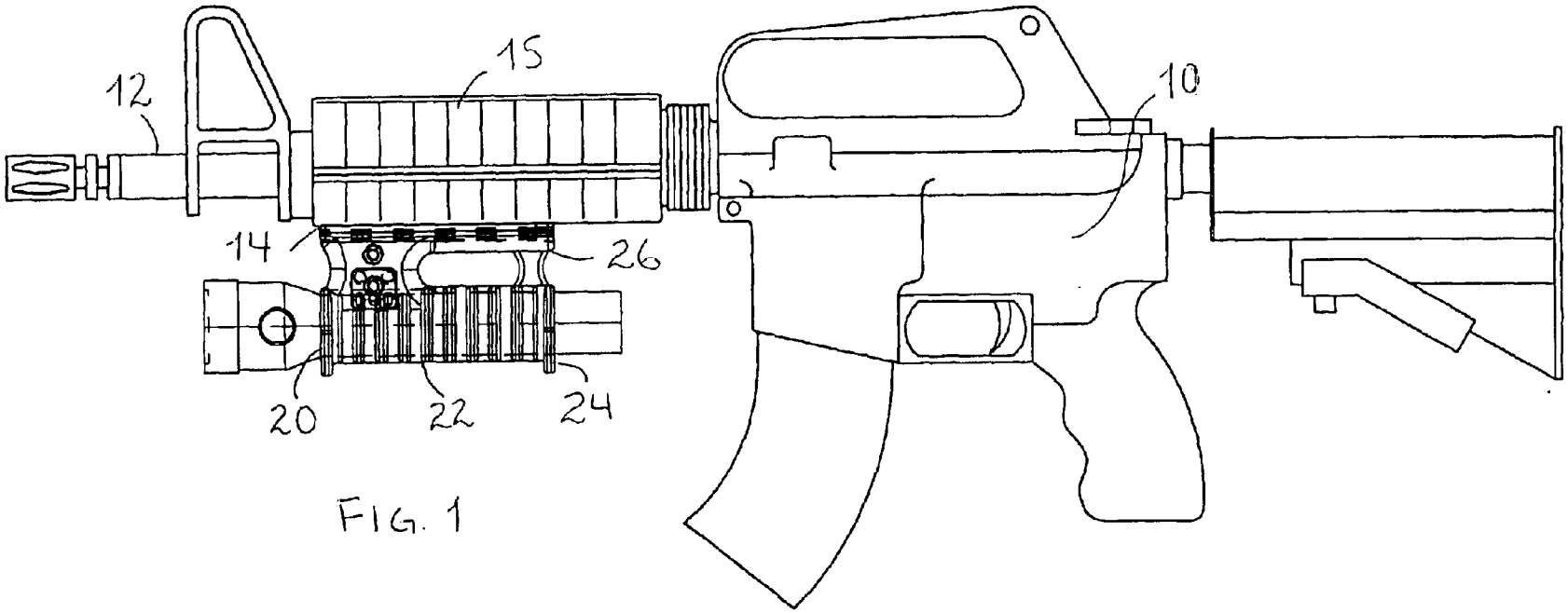
FIG. 1 is a plan view of a flashlight mount according to one embodiment of the invention mounted on a rifle.

With reference to FIG. 1, there is shown a plan view of a flashlight mount 20 according to one embodiment of the invention mounted on a rifle 10 having a barrel 12 and a mounting rail 14 (which can include a rail extension) coupled to a hand guard 15 affixed around the barrel. Rifle 10 can be an M-16, or any other rifle or carbine, for which the mount of the present invention is particularly suitable. Alternatively, it will be appreciated that the mount of the present invention can be used on any hand held firearm having an elongate barrel and a mounting rail (of preferably about 10 cm or more) coupled to the barrel. Thus, for purposes of the present application, the term rifle will be used to include all these weapons.

The flashlight mount 20 includes a frame 22 having a bore 24 for receiving a flashlight (not shown), and a base 26 for mounting on the mounting rail 14. Preferably, bore 24 is a throughgoing bore, to permit insertion of a flashlight which is actuated from the front or one which is actuated from the rear. Alternatively, if only a flashlight actuated from the front is to be used, the bore need not extend throughout the entire length of the frame. It is a particular feature of the invention that the base is distanced from the frame, as by bridging members, creating a finger-receiving aperture therebetween.

Figure 3:
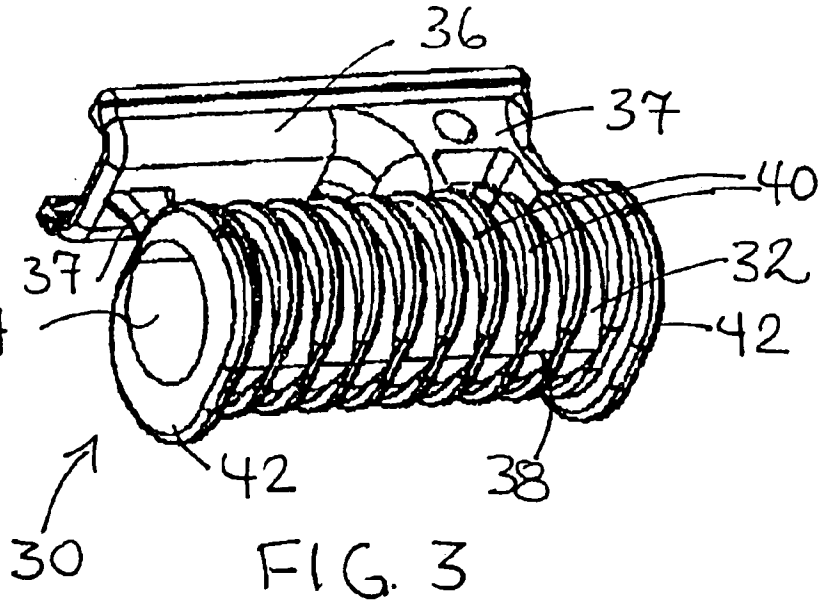
FIG. 3 is a bottom perspective view of the flashlight mount of FIG. 2.
Figure 2:
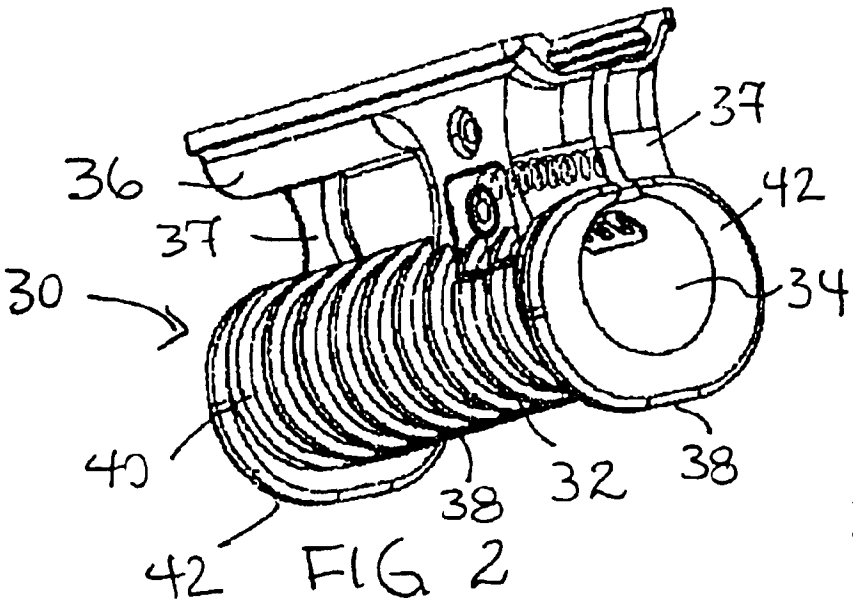
FIG. 2 is a partially cut-away side perspective view of a flashlight mount according to the invention.
Figure 4:
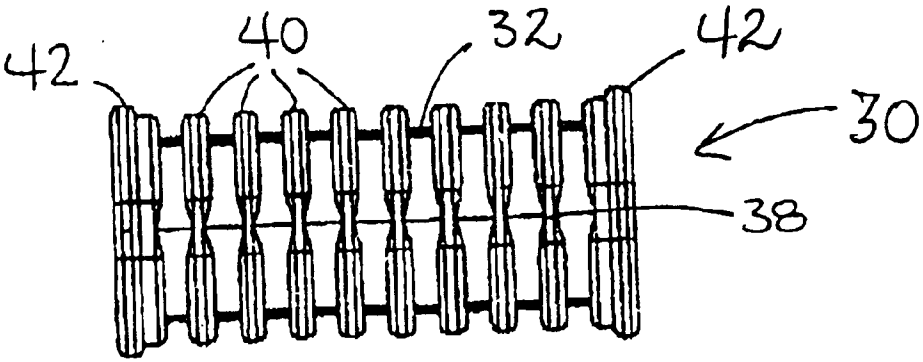
FIG. 4 is a bottom view of the flashlight mount of FIG. 2.

Referring now to FIGS. 2, 3 and 4, there are shown a partially cut-away side perspective view, a bottom perspective view, and a bottom view, respectively, of a flashlight mount 30 according to one embodiment of the invention. Flashlight mount 30 includes a frame 32 having a throughgoing bore 34 for receiving a flashlight. Frame 32 is preferably formed of a reinforced nylon composition, and most preferably formed of a heat insulated material.

Flashlight mount 30 also includes a base 36 for mounting along the mounting rail on the weapon. As can be seen in the illustrated embodiment, base 36 is distanced from the frame 32, as by at least one bridge element 37. The presence of bridge elements 37 distances the frame from the barrel of the weapon, both for protection from the heat of the barrel, and in order to permit the user to wrap his or her fingers around the flashlight mount during firing. This increases the comfort and confidence of the user, and the stability of the weapon during firing. This is particularly important when firing an M-16 type rifle, It is a particular feature of the invention that the mounting location of the flashlight mount is adjustable along the mounting rail, rather than being defined in advance, as in conventional mounts. In this way, each user can adjust the location of the mount to his or her optimum location for gripping the mount, taking into account the length of the user's arm (and the length of the mounting rail). Preferably, locking means are provided in the base for locking the flashlight mount at a selected location along the mounting rail. The locking means may be spring biased, or of any other design.

It is a further particular feature of the invention that frame 32 defines a substantially flattened bottom surface 38. Bottom surface 38 provides a flat, stable surface for resting the barrel of the weapon on a wall or other surface, when the light mount is affixed thereto, which improves aiming of the weapon at a target, Frame 32 of flashlight mount 30 also includes a plurality of bottom-flattened rings 40 around the bore 34, preferably integrally formed with the frame. Rings 40 provide a substantially elliptical shape to frame 32, whereby the frame can be gripped easily and securely by the fingers of a user. An added advantage of rings 40 is that they provide reinforcement for the mount, thus increasing stability but a reduced weight relative to a thicker diameter mount. In addition, frame 32 merges into an outwardly extending flange 42 at each end. Flanges 42 provide stops for a hand of a user, both for adjusting the location of the mount along the mounting rail, and during use of the weapon. Preferably, flanges 42 are also flat bottomed for increased stability when resting the rifle on a wall or other surface. In addition, flanges 42 serve to protect a flashlight whose front diameter exceeds the diameter of the bore. Thus, conical flashlights can easily be accommodated without risking damage to the light.

According to a preferred embodiment, as illustrated in FIG. 1, the mount is coupled beneath the barrel. Alternatively, the mount can be affixed on the side of the barrel, or in any other location where there is a mounting rail or rail extension. Such an option provides light, but does not have the advantages of providing a hand grip for the user, as does the embodiment of FIG. 1.

It will be appreciated that the invention is not limited to what has been described hereinabove merely by way of example. Rather, the invention is limited solely by the claims which follow.

What is claimed is:

1. A flashlight mount for a rifle having a barrel and a mounting rail coupled to the barrel, the flashlight mount comprising (1) a frame having a bore for receiving a flashlight, said frame defining a substantially flattened bottom surface and an outwardly extending flange at each end of said frame; and (2) a base for mounting the frame along the mounting rail, said base being distanced from the frame, creating a finger-receiving aperture therebetween.

2. The flashlight mount according to claim 1, wherein said base is coupled to said frame by at least one bridge element for distancing said base from the frame.

3. The flashlight mount according to claim 1, wherein said frame includes a plurality of bottom-flattened rings around the bore.

4. The flashlight mount according to claim 2, wherein said frame includes a plurality of bottom-flattened rings around the bore.

5. The flashlight mount according to claim 2, wherein said frame includes an outwardly extending flange at each end of said frame.

6. The flashlight mount according to claim 1, wherein each said flange includes has a substantially flat bottom.

7. The flashlight mount according to claim 3, wherein each said flange has a substantially flat bottom.

8. The flashlight mount according to claim 1, wherein said base is mounted along the mounting rail at an adjustable location.

9. The flashlight mount according to claim 1, further comprising means for locking said base at a selected location along the mounting rail.

10. The flashlight mount according to claim 2, further comprising means for locking said base at a selected location along the mounting rail.

11. The flashlight mount according to claim 1, further comprising means for locking said base at a selected location along the mounting rail.

12. The flashlight mount according to claim 1, wherein said bore is a throughgoing bore.

13. The flashlight mount according to claim 2, wherein said bore is a throughgoing bore.

14. A method for forming a flashlight on a rifle having a barrel and a mounting rail coupled to the barrel, the method comprising:

preparing a frame, said frame defining a substantially flattened bottom surface and an outwardly extending flange at each end; preparing a base for mounting the frame along the mounting rail;

creating a bore for receiving a flashlight in said frame; and distancing said base from the frame, thereby creating a finger-receiving aperture therebetween.

* * * * *